US010428465B2

(12) United States Patent
Rouse et al.

(10) Patent No.: US 10,428,465 B2
(45) Date of Patent: Oct. 1, 2019

(54) HIGH STRENGTH AND LOW STIFFNESS AGAVE TISSUE

(71) Applicant: Kimberly-Clark Worldwide, Inc., Neenah, WI (US)

(72) Inventors: Kayla Elizabeth Rouse, Appleton, WI (US); Richard Louis Underhill, Neenah, WI (US); Thomas Gerard Shannon, Neenah, WI (US); John Matthew Reiser, Snellville, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/324,964

(22) PCT Filed: Oct. 27, 2016

(86) PCT No.: PCT/US2016/059105
§ 371 (c)(1),
(2) Date: Feb. 12, 2019

(87) PCT Pub. No.: WO2018/080494
PCT Pub. Date: May 3, 2018

(65) Prior Publication Data

US 2019/0169798 A1 Jun. 6, 2019

(51) Int. Cl.

| | |
|---|---|
| ***D21H 27/00*** | (2006.01) |
| ***D21F 11/14*** | (2006.01) |
| ***D21H 11/12*** | (2006.01) |
| ***D21H 27/38*** | (2006.01) |

(52) U.S. Cl.
CPC ..... *D21H 27/005* (2013.01); *D21F 11/145* (2013.01); *D21H 11/12* (2013.01); *D21H 27/00* (2013.01); *D21H 27/002* (2013.01); *D21H 27/38* (2013.01)

(58) Field of Classification Search
CPC .... D21H 27/002; D21H 11/12; D21H 27/005; D21H 27/38; D21H 27/00; D21H 11/00; D21H 27/004; D21H 27/007; D21F 11/145; D21F 11/00; B32B 2317/12
See application file for complete search history.

(56) References Cited

U.S. PATENT DOCUMENTS

| | | | | |
|---|---|---|---|---|
| 2003/0121629 | A1 | 7/2003 | Hu | |
| 2007/0298995 | A1 | 12/2007 | Eggers et al. | |
| 2009/0068633 | A1* | 3/2009 | Cohen | G09B 19/0076 434/428 |
| 2010/0087117 | A1* | 4/2010 | Peyras-Carratte | A47L 13/16 442/356 |
| 2011/0027545 | A1* | 2/2011 | Harlacher | D21H 21/28 428/195.1 |
| 2012/0273147 | A1* | 11/2012 | Edwards | D21H 11/00 162/141 |
| 2018/0002864 | A1* | 1/2018 | Ziegenbein | C08J 5/18 |
| 2018/0135248 | A1* | 5/2018 | Collins | D21H 27/002 |
| 2018/0135253 | A1* | 5/2018 | Shannon | D21H 27/002 |
| 2018/0142421 | A1* | 5/2018 | Rouse | D21H 27/005 |
| 2018/0187377 | A1* | 7/2018 | Ziegenbein | D21H 17/44 |
| 2019/0169798 | A1* | 6/2019 | Rouse | D21H 27/005 |

FOREIGN PATENT DOCUMENTS

| | | | | |
|---|---|---|---|---|
| CA | 2168894 | | 8/1997 | |
| CN | 104116454 | B | 6/2017 | |
| JP | 7197400 | A2 | 8/1995 | |
| WO | WO2016195625 | A1 | 12/2016 | |
| WO | WO-2018080494 | A1 * | 5/2018 | D21H 27/00 |

OTHER PUBLICATIONS

Iñiguez_Covarrubias et al., in "Utilization of byproducts from the tequila industry: part 1 : agave bagasse as a raw material for animal feeding and fiberboard production" Bioresource Technology, vol. 77, pp. 25-32 (Year: 2001).*

Idarraga et al., in "Pulp and Paper from Blue Agave Waste from Tequila Production," J. Agric. Food Chem. vol. 47, pp. 4450-4455. (Year: 1999).*

Iñiguez_Covarrubias et al., in "Utilization of by-products from the tequila industry. Part 2: potential value of Agave tequilana Weber azul leaves" Bioresource Technology, vol. 77, pp. 101-108. (Year: 2001).*

Co-pending U.S. Appl. No. 16/319903, filed Jan. 23, 2019, by Rouse et al. for "High Bulk Wet-Pressed Agave Tissue."

Co-pending PCT Application No. WO/2018/080492 filed Oct. 27, 2016, by Rouse et al. for "Fibrous Structures Comprising Volatile Agave Compounds."

Escoto-Garcia, T. et al., "Fermentative-Chemical and Mechanical Treatment of Agave Bagasse (Agave Tequilana Weber) for its Application in Hand Crafted Paper," Revista Mexicana de Ingenieria Quimica, Nov. 30, 2006, vol. 5, No. Suppl. 1, pp. 23-27.

(Continued)

*Primary Examiner* — Jose A Fortuna
(74) *Attorney, Agent, or Firm* — Kimberly-Clark Worldwide, Inc.

(57) ABSTRACT

The invention provides tissue products comprising *agave* fibers and methods of producing the same. Preferably the *agave* fibers are high yield *agave* pulp fibers, which have demonstrated the ability to replace a substantial portion of the long fiber fraction of the furnish without negatively effecting important tissue product properties such as stiffness, CD Durability and bulk. Thus, the tissue product may comprise greater than about 10 weight percent *agave* fiber and more preferably greater than about 25 weight percent. Accordingly, in certain embodiments the present disclosure provides a three-layered through-air dried tissue product comprising high-yield *agave* fibers from the leaves of *Agave tequilana, Eucalyptus* Hardwood Kraft (EHWK) and Northern Softwood Kraft (NSWK), wherein the high-yield *agave* fibers comprise 10.0 percent by weight of the tissue product, the product having a CD durability greater than about 18 and sheet bulk greater than about 10 cc/g.

18 Claims, No Drawings

(56) References Cited

OTHER PUBLICATIONS

Ghosh, A. K., "Fundamentals of Paper Drying—Theory and Application from Industrial Perspective," Evaporation, Condensation and Heat Transfer, Sep. 12, 2011, pp. 535-582.
Idarraga, G. et al., "Pulp and Paper from Blue Agave Waste from Tequila Production," Journal of Agricultural and Food Chemistry, vol. 47, No. 10, Sep. 4, 1999, pp. 4450-4455.
Iniguez-Covarrubias, G. et al., "Utilization of By-Products from the Tequila Industry. Part 2: Potential Value of Agave Tequilana Weber Azul Leaves," Bioresource Technology, vol. 77, No. 2, Jan. 4, 2001, pp. 101-108.
Jaouadi, M. et al., "A Study of the Physical and Mechanical Properties of Paper Made from *Agave Americana* L. Fibers," Materials and Manufacturing Processes, vol. 26, No. 4, Apr. 22, 2011, pp. 567-572.

* cited by examiner

HIGH STRENGTH AND LOW STIFFNESS AGAVE TISSUE

BACKGROUND OF THE DISCLOSURE

Tissue products, such as facial tissues, paper towels, bath tissues, and the like, are designed to provide good bulk, a soft feel, and good strength and durability. Unfortunately, however, when steps are taken to increase one property, other characteristics are often adversely affected. For example, softness must generally be balanced against strength and durability. Durability in tissue products can be defined in terms of tensile strength, tensile energy absorption (TEA), burst strength and tear strength. Typically tear, burst and TEA will show a positive correlation with tensile strength while tensile strength, and thus durability, and softness are inversely related. Thus the paper maker is continuously challenged with the need to balance the need for softness with a need for strength and durability.

To achieve an optimal balance of softness and strength, the tissue maker typically relies upon blending wood pulp fibers having different physical properties such as fiber length and fiber coarseness. For example, easily collapsible, low coarseness long fibers, such as Northern softwood kraft (NSWK) fibers are commonly combined with short, low coarseness hardwood kraft fibers such as *Eucalyptus* hardwood kraft (EHWK) fibers. The long, low coarseness fibers provide strength and durability without overly stiffening the tissue web, while the short low coarseness fibers provide a soft hand feel and minimal strength development. The benefits of the various fiber types may be further enhanced by forming a layered tissue web in which the different fibers are selectively deposited in certain layers to provide maximal benefit.

While NSWK provides many benefits to the tissue maker, the supply of NSWK is under significant pressure both economically and environmentally and alternatives are limited. For example, southern softwood kraft (SSWK) may only be used in limited amounts in the manufacture of tissue products because its high coarseness results in stiffer, harsher feeling products than NSWK. Thus, there remains a need for an alternative to NSWK for the manufacture of tissue products, which must be both soft and strong.

SUMMARY OF THE DISCLOSURE

It has now been discovered that fiber derived from non-wood plants of the genus *Agave*, of the family Asparagaceae, such as *Agave tequilana, Agave sisalana* and *Agave fourcroydes*, may be used in the manufacture of tissue product without sacrificing important tissue properties such as strength, durability, bulk and stiffness. These benefits may be achieved even when the *agave* fiber displaces a portion of the long fiber fraction of the furnish. For example, *agave* fiber may displace at least about 25 percent, and in certain instances at least about 50 percent, of the long fiber fraction of the furnish without negatively affecting important tissue properties such as strength, durability, bulk and stiffness. In fact, the present inventors have now discovered that in certain instances high yield *agave* fibers may actually substitute a portion of the long fiber fraction of the furnish and result in an improved tissue product.

Accordingly, in one embodiment the present invention provides a tissue product, and more preferably a through-air dried tissue product, comprising *agave* fiber, the tissue product having a geometric mean tensile (GMT) from about 600 to about 1,200 g/3", a sheet bulk greater than about 12.0 cc/g and a Stiffness Index less than about 8.0. Surprisingly, the foregoing properties are comparable or better than those observed in similarly prepared tissue products consisting entirely of wood pulp fibers, including blends of short and long fiber wood pulp fibers.

In still other embodiments the present invention provides a tissue product comprising at least about 10 percent, by weight of the tissue product, high yield *agave* fiber, the tissue product having a sheet bulk greater than about 12.0 cc/g and a CD Durability Index greater than about 18.0.

In yet another embodiment the present invention provides a tissue product comprising at least about 10 percent, by weight of the tissue product, high yield *agave* fiber, and comprising less than about 35 percent, by weight of the tissue product, long average fiber length wood pulp fibers, such as NSWK and SSWK, the tissue product having a sheet bulk greater than about 12.0 cc/g, a Stiffness Index less than about 10.0 and a CD Durability greater than about 18.0.

In another embodiment the present invention provides a tissue product comprising at least about 10 percent, by weight of the tissue product, high yield *agave* fiber, the tissue product having a CD Stretch greater than about 12.0 percent, a CD Durability greater than about 18.0 and a Stiffness Index less than about 10.0.

In other embodiments the present invention provides a single-ply through-air dried tissue product having a basis weight from about 35 to about 45 gsm, a CD stretch greater than about 10.0 percent, and a CD Durability Index greater than about 18.0, the tissue product comprising at least about 10 percent, by weight of the tissue product, high yield *agave* fiber.

In still other embodiments the present invention provides a method of making a tissue web comprising the steps of: (a) forming an aqueous suspension of high yield *agave* pulp fibers (b) depositing an aqueous suspension of high yield *agave* pulp fibers onto a forming fabric; (c) dewatering the web to a consistency of about 20 percent or greater; (d) transferring the web to a throughdrying fabric; and (e) throughdrying the web, wherein the web comprises at least about 10 percent, by weight of the tissue web, high yield *agave* pulp fibers.

Definitions

As used herein the term "Tissue Web" refers to a structure comprising a plurality of fibers such as, for example, papermaking fibers and more particularly pulp fibers, including both wood and non-wood pulp fibers, and synthetic staple fibers. A non-limiting example of a tissue web is a wet-laid sheet material comprising pulp fibers.

As used herein the term "Tissue Product" refers to products made from tissue webs and includes, bath tissues, facial tissues, paper towels, industrial wipers, foodservice wipers, napkins, medical pads, and other similar products. Tissue products may comprise one, two, three or more plies.

As used herein the term "Layer" refers to a plurality of strata of fibers, chemical treatments, or the like within a ply.

As used herein, the terms "Layered Tissue Web," "Multi-Layered Tissue Web," and "Multi-Layered Web," generally refer to sheets of paper prepared from two or more layers of furnish which are preferably comprised of different fiber types. The layers are preferably formed from the deposition of separate streams of dilute furnish, upon one or more endless foraminous screens. If the individual layers are initially formed on separate foraminous screens, the layers are subsequently combined (while wet) to form a layered composite web.

The term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Basis Weight" generally refers to the bone dry weight per unit area of a tissue and is generally expressed as grams per square meter (gsm). Basis weight is measured using TAPPI test method T-220.

As used herein, the term "Burst Index" refers to the dry burst peak load (typically having units of grams) at a relative geometric mean tensile strength (typically having units of g/3") as defined by the equation:

$$\text{Burst Index} = \frac{\text{Dry Burst Peak Load (g)}}{GMT\ (\text{g}/3'')} \times 10$$

While Burst Index may vary, tissue products prepared according to the present disclosure generally have a Burst Index greater than about 8.0, more preferably greater than about 8.5 and still more preferably greater than about 9.0, such as from about 8.0 to about 10.0.

As used herein, the term "CD TEA Index" refers the CD tensile energy absorption (typically having units of g·cm/cm$^2$) at a given CD tensile strength (typically having units of g/3") as defined by the equation:

$$CD\ TEA\ \text{Index} = \frac{CD\ TEA\ (\text{g}\cdot\text{cm/cm2})}{CDT\ (\text{g}/3'')} \times 1{,}000$$

While the CD TEA Index may vary, tissue products prepared according to the present disclosure generally have a CD TEA Index greater than about 8.0, more preferably greater than about 8.5 and still more preferably greater than about 9.0, such as from about 8.0 to about 10.0.

As used herein, the term "CD Tear Index" refers to the CD Tear Strength (typically expressed in grams) at a given CD tensile strength (typically having units of g/3") as defined by the equation:

$$CD\ \text{Tear Index} = \frac{CD\ \text{Tear (g)}}{CDT\ (\text{g}/3'')} \times 100$$

While the CD Tear Index may vary, tissue products prepared according to the present disclosure generally have a CD Tear Index greater than about 1.5, more preferably greater than about 2.0, and still more preferably greater than about 2.5 such as from about 1.5 to about 3.0.

As used herein, the term "CD Durability Index" refers to the sum of the CD Stretch, CD Tear Index and the CD TEA Index, and is an indication of the durability of the product at a given CD tensile strength. CD Durability Index is defined by the equation:

$$\text{Durability Index} = \text{CD Tear Index} + \text{CD TEA Index} + \text{CD Stretch}$$

While the CD Durability Index may vary, tissue products prepared according to the present disclosure generally have a CD Durability Index greater than about 18.0, more preferably greater than about 19.0, and still more preferably greater than about 20.0 such as from about 18.0 to about 23.0.

As used herein, the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "Sheet Bulk" refers to the quotient of the caliper (μm) divided by the bone dry basis weight (gsm). The resulting sheet bulk is expressed in cubic centimeters per gram (cc/g). Tissue products prepared according to the present invention generally have a sheet bulk greater than about 10.0 cc/g, more preferably greater than about 12.0 cc/g and still more preferably greater than about 14.0 cc/g.

As used herein, the term "Fiber Length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i \times n_i)/n$$

where k=maximum fiber length
$x_i$=fiber length
$n_i$=number of fibers having length $x_i$
n=total number of fibers measured.

As used herein the term "Fiber" means an elongate particulate having an apparent length greatly exceeding its apparent width. More specifically, and as used herein, fiber refers to such fibers suitable for a papermaking process and more particularly the tissue paper making process.

As used herein, the term "*Agave* Fiber" refers to a fiber derived from a plant of the genus *Agave* of the family Asparagaceae including, for example, *Agave tequilana. Agave tequilana, Agave sisalana* and *Agave fourcroydes*. The fibers are generally processed into a pulp for use in the manufacture of tissue products according to the present invention. Preferably the pulping process is a high yield pulping process.

As used herein the term "Wood Fiber" refers to a fiber derived from a vascular plant having secondary growth, including for example woody plants such as hardwoods and softwoods.

As used herein the term "Furnish" generally refers to a slurry of one or more fibers useful in the manufacture of tissue webs.

As used herein, the term "Long Wood Fiber" refers wood fibers having an average fiber length of at least about 2.0 mm. Long wood fiber may be useful in forming tissue products of the present invention and may comprise a portion of the papermaking furnish. Suitable long wood fiber for use in the invention may include, for example, softwood fibers such as Northern Softwood Kraft (NSWK) fibers or Southern Softwood Kraft (SSWK) fibers.

As used herein, the term "Short Wood Fiber" refers to wood fibers having an average fiber length less than about 2.0 mm, such as from about 0.5 to about 2.0 mm and more preferably from about 0.75 to about 1.5 mm. Short wood fiber may be useful in forming tissue products of the present invention and may comprise a portion of the papermaking furnish. Suitable short wood fiber for use in the invention may include, for example, hardwood fibers such as *Eucalyptus* Hardwood Kraft (EHWK) fibers.

As used herein, the term "Slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms per sample width, such as kg/3".

As used herein, the term "Geometric Mean Slope" (GM Slope) generally refers to the square root of the product of machine direction slope and cross-machine direction slope. GM Slope generally is expressed in units of kg.

As used herein, the terms "Geometric Mean Tensile" (GMT) refers to the square root of the product of the machine direction tensile strength and the cross-machine direction tensile strength of the web.

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}000$$

While the Stiffness Index may vary, tissue products prepared according to the present disclosure generally have a Stiffness Index less than about 10.0, more preferably less than about 9.0 and still more preferably less than about 8.0, such as from about 6.0 to about 10.0.

DETAILED DESCRIPTION OF THE DISCLOSURE

The present inventors have successfully used *agave* fibers to produce tissue webs and products having satisfactory softness, strength and bulk. To produce the instant tissue products the inventors have successfully moderated the changes in important tissue properties such as strength and stiffness typically associated with non-wood fibers. In particular embodiments the inventors have even been able to replace a portion of the long fiber fraction with *agave* fibers without deleterious effect. Not only have the inventors succeeded in moderating changes to the tissue's strength and stiffness, they have been able to so without negatively effecting bulk. As such, the tissue products of the present invention have properties comparable to or better than those produced using conventional papermaking fibers such as hardwood and softwood kraft pulp fibers.

The ability to substitute the long fiber fraction with *agave* fiber is particularly surprising provided *agave*'s relatively short fiber length compared to NSWK and SSWK, as illustrated in the table below.

TABLE 1

| Fiber | Average Fiber Length (mm) | Average Fiber Width (μm) | Aspect Ratio | Coarseness (mg/100 m) |
|---|---|---|---|---|
| NSWK | 3.5 | 36 | 97 | 21.3 |
| SSWK | 4.0 | 43 | 93 | 14.8 |
| High Yield Agave Fiber | 1.1 | 44 | 25 | 12.7 |

Despite having a substantially shorter fiber length compared to softwood kraft fibers, *agave* may displace a portion of these fibers in the furnish and provide tissue products having satisfactory physical properties. As such, the tissue webs and products of the present invention generally comprise at least about 10 percent, by weight of the web or product, and more preferably at least about 20 percent and still more preferably at least about 25 percent, *agave* fiber.

The *agave* fiber may displace a portion of, or all of, the long wood fiber fraction of the furnish such that the tissue product or web comprises less than about 35 percent, by weight of the product, wood pulp fibers having an average fiber length greater than about 2.0 mm, such as NSWK or SSWK. In particularly preferred embodiments the invention provides a tissue product comprising from about 1.0 to about 30 percent, by weight of the tissue product, NSWK, such as from about 5.0 to about 30 percent and more preferably from about 10 to about 20 percent. In other embodiments the tissue products are substantially free from wood pulp fibers having an average fiber length greater than about 2.0 mm, such as NSWK or SSWK.

In a particularly preferred embodiment the tissue product comprises a multi-layered through-air dried web wherein *agave* fiber is selectively disposed in only one of the layers. For example, in one embodiment the tissue web may comprise a two layered web wherein the first layer consists essentially of hardwood kraft pulp fibers and is substantially free of *agave* fiber and the second layer comprises *agave* fiber, wherein the *agave* fiber comprises at least about 25 percent by weight of the second layer, such as from about 25 to about 100 percent by weight of the second layer. In the foregoing example, the *agave* fiber may comprise from about 10 to about 40 percent, by weight of the tissue product and the product may comprise less than about 35 percent, by weight of the product, wood pulp fibers having an average fiber length greater than about 2.0 mm, such as NSWK or SSWK. In certain instances the web may be substantially free from long wood pulp fibers such that the second layer consists essentially of *agave* fiber. It should be understood that, when referring to a layer that is substantially free of a particular fiber type, negligible amounts of the given fiber may be present therein, however, such small amounts often arise from the given fibers applied to an adjacent layer, and do not typically substantially affect the softness or other physical characteristics of the web.

In further preferred embodiments the present invention provides a three layered web where the *agave* fiber is selectively disposed in the middle layer and the two outer layers consist essentially of hardwood kraft fibers, such as EWHK and are substantially free of *agave* fiber. In addition to *agave* fiber, the middle layer may also comprise wood pulp fibers having an average fiber length greater than about 2.0 mm. In such embodiments the *agave* fiber generally comprises at least about 25 percent by weight of the middle layer, such as from about 25 to about 75 percent by weight of the middle layer. In the foregoing embodiment, the *agave* fiber may comprise from about 10 to about 40 percent, by weight of the tissue product, and the product may comprise less than about 35 percent, by weight of the product, wood pulp fibers having an average fiber length greater than about 2.0 mm, such as NSWK or SSWK.

In still other embodiments the *agave* fiber may displace substantially all of the long wood fiber fraction of the furnish such that the resulting tissue web or product is substantially free from wood fibers having an average fiber length greater than about 2.0 mm, such as NSWK or SSWK. For example, a web may comprise three layers where the two outer layers consist essentially of hardwood kraft fibers, such as EWHK, and the middle layer consists essentially of *agave* fiber. In such embodiments *agave* fiber may comprise from about 10 to about 40 percent, by weight, of the tissue web or product.

The tissue webs may be incorporated into tissue products that may be either single- or multi-ply, where one or more of the plies may be formed by a multi-layered tissue web having *agave* fibers selectively incorporated in one of its layers. In one embodiment the tissue product is constructed such that the *agave* fibers are not brought into contact with the user's skin in-use. For example, the tissue product may comprise two multi-layered through-air dried webs wherein each web comprises a first fibrous layer substantially free from *agave* fibers and a second fibrous layer comprising *agave* fibers. The webs are plied together such that the outer surface of the tissue product is formed from the first fibrous layer of each web and the second fibrous layer comprising the *agave* fibers is not brought into contact with the user's skin in-use.

Generally *agave* fibers useful in the present invention are derived from non-woody plants in the genus *Agave* of the family Asparagaceae. Suitable species within the genus *Agave* include, for example, *Agave tequilana, Agave sisalana* and *Agave fourcroydes*.

In certain embodiments the *agave* fibers are processed by a high yield pulping process, such as mechanically treating the fibers. High yield pulping processes include, for example, mechanical pulp (MP), refiner mechanical pulp (RMP), pressurized refiner mechanical pulp (PRMP), thermomechanical pulp (TMP), high temperature TMP (HT-TMP), RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Processing of *agave* fibers using a high yield pulping process generally results in a pulp having a yield of at least about 50 percent, more preferably at least about 65 percent and still more preferably at least about 85 percent, such as from about 50 about 95 percent and more preferably from about 65 to about 90 percent.

The high yield pulping process may comprise heating the *agave* fiber above ambient, such as from about 70 to about 200° C., and more preferably from about 90 to about 150° C. while subjecting the fiber to mechanical forces. Caustic or an oxidizing agent may be introduced to the process to facilitate fiber separation by the mechanical forces. For example, in one embodiment, a solution of 3 to about 8 percent NaOH and a solution of 3 to about 8 percent peroxide may be added to the fiber during mechanical treatment to facilitate fiber separation.

In other embodiments the high yield pulping process may comprise treating *agave* leaves with an alkaline pulping solution such as that disclosed in U.S. Pat. No. 6,302,997, the contents of which are incorporated herein in a manner consistent with the present disclosure. Alkaline treatment may be carried out at a pressure from about atmospheric pressure to about 30 psig and at a temperature ranging from about ambient temperature to about 150° C. The alkaline hydroxide may be added, based upon the oven dried mass of the *agave* leaves, from about 10 to about 30 percent. Suitable alkaline pulping solutions include, for example, sodium hydroxide, potassium hydroxide, ammonium hydroxide, calcium hydroxide and combinations thereof. After alkaline treatment, the *agave* is mechanically worked and then treated with an acid solution to reduce the pH to an acid pH.

In other embodiments the high yield pulping process may comprise impregnating *agave* leaves with a solution of nitric acid and optionally ammonium hydroxide at ambient temperatures under atmospheric pressure, such as described in U.S. Pat. No. 7,396,434, the contents of which are incorporated herein in a manner consistent with the present invention. The impregnated leaves are then heated to evaporate the nitric acid followed by treatment with an alkaline solution before being cooled.

Although a caustic, such as NaOH, or oxidizing agent, such as nitric acid or peroxide, may be added during processing, it is generally preferred that the *agave* fiber is not pretreated with a sodium sulfite or the like prior to processing. For example, high yield *agave* pulps are generally prepared without pretreatment of the fiber with an aqueous solution of sodium sulfite or the like, which is commonly employed in the manufacture of chemi-mechanical wood pulps.

The use of *agave* fiber, and in a particularly preferred embodiment high yield *agave* pulp fibers, results in tissue webs and products having favorable physical properties. For example, in one embodiment, the present invention provides a tissue product comprising at least one multi-layered tissue web, where *agave* is selectively deposited in one of the layers and comprises at least about 10 percent, by weight of the web, the product having a GMT from about 600 to about 1,200 g/3" and a GM Slope less than about 8.0 kg. In still other embodiments the present disclosure provides a tissue product having a GMT from about 750 to about 1,000 g/3" and a GM Slope less than about 7.0 kg, such as from about 4.5 to about 7.0 kg, and comprising from about 5 to about 50 percent, by weight of the tissue product, high yield *agave* pulp fiber. At the foregoing tensile strengths and modulus the tissue products of the present invention are also generally soft and have low stiffness, such as having a Stiffness Index less than about 10.0, and more preferably less than about 9.0, such as from about 6.0 to about 9.0.

The improved properties are further illustrated in the table below which compares the change in various tissue product properties relative to comparable tissue products comprising NSWK. All tissues shown in Table 2 are similarly manufactured through-air dried single-ply products having a basis weight of about 36 grams per square meter (gsm) and comprising either 40 weight percent NSWK or a blend of high yield *agave* fiber (10 wt %) and NSWK (30 wt %) and EHWK (60 wt %). Surprisingly *agave* provides comparable levels of durability without stiffening or dramatically increasing tensile strength.

TABLE 2

| | Control | High Yield Agave Fiber |
|---|---|---|
| Furnish (wt %) | 60 EHWK/40 NSWK | 60 EHWK/30 NSWK/10 Agave |
| GMT (g/3") | 983 | 1024 |
| Sheet Bulk (cc/g) | 14.5 | 13.9 |
| Stiffness Index | 6.96 | 6.84 |
| Burst Index | 8.46 | 8.97 |
| CD Durability | 21.93 | 22.52 |

Accordingly, the present invention provides tissue products that are not only soft, but also highly durable at relatively modest tensile strengths. As such the tissue products generally have a GMT less than about 1,200 g/3", such as from about 600 to about 1,200 g/3", and more preferably from about 750 to about 1,000 g/3", but still have a CD Durability Index greater than about 18, such as from about 18 to about 24.

In other embodiments the tissue products have a Stiffness Index less than about 10.0 and a CD Durability Index greater than about 18, such as from about 18 to about 24. In one particularly preferred embodiment the tissue product comprises a through-air dried web comprising less than about 40 weight percent NSWK, such as from about 5 to about 40 weight percent and more preferably from about 5 to about 30 weight percent, and from about 10 to about 25 weight percent high yield *agave* fiber, the tissue product having a CD Durability Index greater than about 18, such as from about 18 to about 24, and a Stiffness Index from about 6.0 to about 10.0.

In still other embodiments the present invention provides a tissue product comprising from about 10 to about 25 weight percent high yield *agave* fiber and about 30 weight percent or less long fiber, such as NSWK or SSWK, the product having a GMT from about 750 to about 1,000 g/3", a Stiffness Index less than about 10.0 and a Burst Index greater than about 8.0, such as from about 8.0 to about 10.0 and more preferably from about 8.5 to about 9.5.

Tissue webs useful in forming tissue products of the present invention can generally be formed by any of a variety of papermaking processes known in the art. For example, a papermaking process of the present disclosure can utilize through-air drying, creped through-air drying, uncreped through-air drying, as well as other steps in forming the tissue web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and be either creped or uncreped. When forming multi-ply tissue products, the separate plies can be made from the same process or from different processes as desired.

If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product. As used herein, a "wet strength agent" is any material that, when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 to about 60 pounds per ton (lbs/T), in some embodiments, between about 5 to about 30 lbs/T, and in some embodiments, between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Test Methods

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength of the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings have an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is less than 450 gf a 10 Newton load cell is used, if peak load is greater than 450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the burst strength.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006 inch) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch)

from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Example

Single-ply uncreped through-air dried (UCTAD) tissue webs were made generally in accordance with U.S. Pat. No. 5,607,551. The tissue webs and resulting tissue products were formed from various fiber furnishes including, *Eucalyptus* Hardwood Kraft (EHWK) pulp, Northern softwood kraft (NSWK) pulp, and high yield *agave* pulp (HYA).

The EHWK furnish was prepared by dispersing about 120 pounds (oven dry basis) EHWK pulp in a pulper for 30 minutes at a consistency of about 3 percent. The fiber was then transferred to a machine chest and diluted to a consistency of 1 percent. The NSWK furnish was prepared by dispersing about 50 pounds (oven dry basis) of NSWK pulp in a pulper for 30 minutes at a consistency of about 3 percent. The fiber was then transferred to a machine chest and diluted to a consistency of 1 percent. The HYA was prepared by dispersing about 50 pounds (oven dry basis) HYA pulp in a pulper for 30 minutes at a consistency of about 3 percent. The fiber was then transferred to a machine chest and diluted to a consistency of 1 percent. HYA was produced by processing *Agave Tequilana* leafs using a three stage non-wood pulping process commercially available from Taizen America (Macon, Ga.). The resulting high yield *agave* fiber had an average fiber length of about 1.1 mm and a fiber coarseness of about 12.74 mg/100 m.

The stock solutions were pumped to a 3-layer headbox after dilution to 0.75 percent consistency to form a three layered tissue web. Layered tissue structures were produced as indicated in Table 3, below. The relative weight percentage of the layers was 30/40%/30%, based upon the total weight of the web. In those instances where starch was added to the web it was added to all layers.

TABLE 3

| Sample | Furnish Layering (wt %) | Redibond 2038 A (kg/ton) | Center Layer Furnish Refining (min) |
|---|---|---|---|
| Control 1 | 30 EHWK/40 NSWK/30 EHWK | 0 | 0 |
| Control 2 | 30 EHWK/40 NSWK/30 EHWK | 3 | 0 |
| Control 3 | 30 EHWK/40 NSWK/30 EHWK | 6 | 0 |
| Inventive 1 | 30 EHWK/30 NSWK 10 HYA/30 EHWK | 0 | 2 |
| Inventive 2 | 30 EHWK/30 NSWK 10 HYA/30 EHWK | 2 | 2 |
| Inventive 3 | 30 EHWK/30 NSWK 10 HYA/30 EHWK | 4 | 2 |

The formed web was non-compressively dewatered and rush transferred to a transfer fabric traveling at a speed about 28 percent slower than the forming fabric. The web was then transferred from the transfer fabric to a T-1205-2 through-drying fabric (commercially available from Voith Fabrics, Appleton, Wis. and previously disclosed in U.S. Pat. No. 8,500,955, the contents of which are incorporated herein in a manner consistent with the present disclosure) with the assistance of vacuum. The web was then dried and wound into a parent roll. The effect of *agave* fibers on various tissue properties, including tensile, durability and stiffness, is summarized in Tables 4 and 5, below.

TABLE 4

| Sample | Basis Weight (gsm) | Sheet Bulk (cc/g) | GMT (g/3") | GM Slope (kg) | CD Tensile (g/3") | CD TEA (g · cm/cm$^2$) | CD Stretch (%) |
|---|---|---|---|---|---|---|---|
| Control 1 | 36.1 | 14.5 | 587 | 4.96 | 392 | 3.35 | 8.7 |
| Control 2 | 35.8 | 13.4 | 856 | 6.51 | 607 | 5.40 | 9.7 |
| Control 3 | 35.9 | 14.5 | 983 | 6.84 | 709 | 6.46 | 10.2 |
| Inventive 1 | 36.9 | 13.7 | 735 | 6.34 | 514 | 4.14 | 9.0 |
| Inventive 2 | 35.9 | 13.0 | 829 | 6.11 | 589 | 5.31 | 10.9 |
| Inventive 3 | 37.3 | 13.9 | 1024 | 7.00 | 742 | 6.74 | 11.3 |

TABLE 5

| Sample | Stiffness Index | Dry Burst (gf) | Burst Index | GM Tear (gf) | CD Tear (gf) | CD Durability Index |
|---|---|---|---|---|---|---|
| Control 1 | 8.46 | 521 | 8.89 | 8.30 | 9.9 | 19.72 |
| Control 2 | 7.60 | 727 | 8.50 | 13.90 | 16.5 | 21.30 |
| Control 3 | 6.96 | 832 | 8.46 | 15.25 | 18.5 | 21.93 |
| Inventive 1 | 8.63 | 623 | 8.48 | 10.61 | 12.0 | 19.35 |
| Inventive 2 | 7.38 | 687 | 8.28 | 10.59 | 12.5 | 22.03 |

TABLE 5-continued

| Sample | Stiffness Index | Dry Burst (gf) | Burst Index | GM Tear (gf) | CD Tear (gf) | CD Durability Index |
|---|---|---|---|---|---|---|
| Inventive 2 | 6.84 | 919 | 8.97 | 14.29 | 16.2 | 22.52 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the following embodiments:

In a first embodiment the present invention provides a tissue product comprising at least about 10 weight percent *agave* fibers, the tissue product having a CD Durability greater than about 18 and a sheet bulk greater than about 10 cc/g.

In a second embodiment the present invention provides the tissue product of the first embodiment having a CD Stretch greater than about 8 percent and more preferably greater than about 10 percent.

In a third embodiment the present invention provides the tissue product of the first or the second embodiments having a CD Durability from about 20 to about 22.

In a fourth embodiment the present invention provides the tissue product of any one of the first through the third embodiments having a geometric mean tensile (GMT) less than about 1,200 g/3" and more preferably less than about 1,000 g/3".

In a fifth embodiment the present invention provides the tissue product of any one of the first through the fourth embodiments having a Stiffness Index less than about 10.0 and more preferably less than about 9.0 and still more preferably less than about 8.0.

In a sixth embodiment the present invention provides the tissue product of any one of the first through the fifth embodiments having a Burst Index greater than about 8.0.

In a seventh embodiment the present invention provides the tissue product of any one of the first through the sixth embodiments wherein the tissue product comprises less than about 35 percent, by weight of the product, wood pulp fibers having an average fiber length greater than about 2.0 mm.

In an eighth embodiment the present invention provides the tissue product of any one of the first through the seventh embodiments comprising from about 10 to about 40 percent, by weight of the tissue product, *agave* fibers.

In a ninth embodiment the present invention provides the tissue product of any one of the first through the eighth embodiments wherein the *agave* fibers are high yield *agave* pulp fibers having a lignin content from about 10 to about 15 weight percent.

In a tenth embodiment the present invention provides the tissue product of any one of the first through the ninth embodiments wherein the tissue product comprises at least one multi-layered tissue web having a middle layer and two outer layers wherein the *agave* fiber is selectively disposed in the middle layer and the two outer layers are substantially free of *agave* fiber.

In an eleventh embodiment the present invention provides the tissue product of any one of the first through the tenth embodiments wherein the tissue product comprises at least one through-air dried tissue web.

In a twelfth embodiment the present invention provides the tissue product of any one of the first through the eleventh embodiments wherein the tissue product comprises a single-ply uncreped through-air dried tissue web.

In a thirteenth embodiment the present invention provides the tissue product of any one of the first through the twelfth embodiments wherein the tissue product is substantially free from wood pulp fibers having an average fiber length greater than about 2.0 mm and comprises from about 5.0 to about 40 percent, by weight of the product, *agave* fibers.

What is claimed is:

1. A tissue product comprising at least one through-air dried tissue web, the tissue web comprising at least about 10 weight percent high yield *agave* pulp fibers and less than about 30 percent, by weight of the tissue product, wood pulp fibers having an average fiber length greater than about 2.0 mm, the tissue product having a CD Durability greater than about 18 and a sheet bulk greater than about 10 cc/g.

2. The tissue product of claim 1 having a CD Stretch greater than about 8 percent.

3. The tissue product of claim 1 having a CD Durability from about 20 to about 22.

4. The tissue product of claim 1 having a geometric mean tensile (GMT) from about 600 to about 1,200 g/3".

5. The tissue product of claim 1 having a Stiffness Index less than about 10.0.

6. The tissue product of claim 1 having a Burst Index greater than about 8.0.

7. The tissue product of claim 1 wherein the at least one tissue web comprises is substantially free from wood pulp fibers having an average fiber length greater than about 2.0 mm.

8. The tissue product of claim 1 wherein the at least one tissue web comprises from about 10 to about 40 percent, by weight of the tissue product, high yield *agave* pulp fibers.

9. The tissue product of claim 1 wherein the high yield *agave* pulp fibers are derived from *Agave tequilana, Agave sisalana* or *Agave fourcroydes* and have an average fiber length less than 2.0 mm.

10. The tissue product of claim 9 wherein the high yield *agave* pulp fibers are mechanically processed and the mechanical process results in a pulp yield of at least about 50 percent and have an average fiber length less than 2.0 mm and a coarseness greater than 12.0 mg/100 m.

11. The tissue product of claim 1 wherein the at least one tissue web comprises an uncreped through-air dried tissue web.

12. A single-ply through-air dried tissue product comprising at least about 10 weight percent high yield *agave* pulp fibers and less than about 30 percent, by weight of the tissue product, wood pulp fibers having an average fiber length greater than about 2.0 mm, the tissue product having a Stiffness Index less than about 10.0 and a sheet bulk greater than about 10 cc/g.

13. The tissue product of claim 12 wherein the ply comprises a middle layer and two outer layers wherein the high yield *agave* pulp fiber is selectively disposed in the middle layer and the two outer layers are substantially free of high yield *agave* pulp fiber.

14. The tissue product of claim 12 having a CD Stretch greater than about 8 percent and a CD Durability from about 20 to about 22.

15. The tissue product of claim 12 having a geometric mean tensile (GMT) from about 600 to about 1,200 g/3".

16. The tissue product of claim 12 having a Stiffness Index from about 8.0 to about 9.0.

17. The tissue product of claim 12 having a Burst Index greater than about 8.0.

18. A method of making a tissue web comprising the steps of:

a. forming an aqueous suspension of high yield *agave* pulp fibers;

b. depositing an aqueous suspension of high yield *agave* pulp fibers onto a forming fabric;

c. dewatering the web to a consistency of about 20 percent or greater;

d. transferring the web to a throughdrying fabric e. throughdrying the web, wherein the web comprises at least about 10 percent, by weight of the tissue web, high yield *agave* pulp fibers, and;

f. converting the web to a rolled tissue product, the product having a geometric mean tensile (GMT) from about 600 to about 1,200 g/3", a Stiffness Index less than about 10.0 and a sheet bulk greater than about 10 cc/g.

* * * * *